United States Patent [19]

Hughes, Jr.

[11] 4,034,489

[45] July 12, 1977

[54] HEATED SNOW SHOVEL

[76] Inventor: John F. Hughes, Jr., Buxton Road, Saco, Maine 04072

[21] Appl. No.: 697,391

[22] Filed: June 18, 1976

[51] Int. Cl.[2] ..... E01H 5/10

[52] U.S. Cl. ..... 37/16; 294/54; 219/201

[58] Field of Search ..... 37/16, 53; 294/54, 57; 219/201

[56] References Cited

U.S. PATENT DOCUMENTS

| | | | |
|---|---|---|---|
| 1,518,320 | 12/1924 | Gates | 37/16 X |
| 2,699,614 | 1/1955 | Welch | 37/16 |
| 2,996,111 | 8/1961 | Mocerino et al. | 294/54 X |
| 3,115,359 | 12/1963 | Hendrick | 294/57 X |
| 3,119,921 | 1/1964 | Czaja | 219/201 |
| 3,406,761 | 10/1968 | Ryan | 37/16 X |
| 3,771,188 | 11/1973 | Guth | 37/16 X |
| 3,806,702 | 4/1974 | Spencer | 219/201 X |
| 3,866,927 | 2/1975 | Tvengsberg | 219/201 X |

*Primary Examiner*—E. H. Eickholt
*Attorney, Agent, or Firm*—Robert D. Farkas

[57] ABSTRACT

This disclosure pertains to a shovel having an electric heating element affixed to the blade portion thereof. A rechargeable battery is utilized to provide energizing power to the heating element. The rechargeable battery, as well as the heating element may be energized by utilizing a power cord adapted to flexibly convey household utility current to the apparatus. The handle portion of the shovel is exposed to some of the heat generated by the heating element thereby providing additional comfort to the user.

8 Claims, 2 Drawing Figures

HEATED SNOW SHOVEL

BACKGROUND OF THE INVENTION

1. The Field of the Invention

This invention relates to snow shovels and more particularly to that class utilizing electrically operated heating elements.

2. Description of the Prior Art

The prior art abounds with various devices of the hand tool variety, which have portions thereof electrically heated. U. S. Pat. No. 2,536,844 issued on Jan. 2, 1951 to C. Frederick et al teaches a thermally operated scraper having a heating element thermally coupled to the metallic blade portion thereof and a handle extending substantially normally from the blade portion. A cover encases the heating element which is disposed on one side of the metallic plate comprising the scraping portion of the apparatus. Power is supplied to the heating element by way of a flexible power cord, adapted to be operated by household utility current.

U. S. Pat. No. 2,699,614 issued on Jan. 18, 1955 to F. R. Welch discloses an electrically heated snow remover comprising substantially a flat metallic plate, having marginal edges extending normally thereto so as to form a chamber, housing an electrically operated heating element. A handle portion extends outwardly and upwardly from the central portion of the plate, in which is encased a power cord, utilized to provide household utility current to the heating element housed within the metallic plate and a cover plate affixed thereto.

Each of the aforementioned Patents suffer the common deficiency of requiring the power cords associated therewith to be electrically connected to a source of household utility current at all times that heat is to be generated and failing to provide for a distribution of heat to the handle portion so as to keep the hands of the user in a warmed condition.

SUMMARY OF THE INVENTION

A primary object of the present invention is to provide a snow removal apparatus, of the household variety, which may be heated utilizing a self contained battery or a power cord consistent with the class of service and the availability of household utility current.

Another object of the present invention is to provide a snow removal shovel whose handle portions are warmed so as to comfort the user.

Still another object of the present invention is to provide a snow removal apparatus in which the heating element portion, utilized to heat the blade, is totally encased within a metallic unitary shroud thereby minimizing shock hazards due to accidentally damaging the heating element.

Yet another object of the present invention is to provide a shovel having conventional structural features, enabling the apparatus to be utilized for digging or other functions other than the removal of snow.

Heretofore, snow removal has been plagued by the adherence of large weighty volumes of snow to the shovel, increasing the thrusting force required to disassociate such volumes of snow from the shovel when being selectively distributed onto a designated area. This problem may be alleviated by heating the blade of the shovel so as to cause the snow, contacting the blade, to melt, thereby providing a film of water acting as a lubricant. Furthermore, heating of the blade enables the user to easily force the blade into snow accumulations whose surfaces or volumes have been hardened into an ice-like state. If some of the heat is diverted to the hand grasping portions of the shovel, the user's hands are kept warm when operating the shovel in inclement weather by providing energizing power for the electrical heating elements housed within the interior compartments of the shovel, obtained from either an electrical power cord which is operated from household utility current or from a rechargeable battery. The user may conveniently operate the apparatus of the present invention in areas adjacent to and remote from local household outlets.

These objects, as well as other objects of the present invention, will become more readily apparent after reading the following description of the accompanying drawings.

DESCRIPTION OF THE PREFERRED EMBODIMENT

The structure and method of fabrication of the present invention is applicable to a unitary hollow blade shaped housing having an interior compartment containing therewithin a heating element which is electrically operated, disposed along a circuitous path so as to provide heat to the lateral surfaces of the blade-like housing. The uppermost regions of the blade terminates in a threaded opening adapted to receive a hollow tubular shaft. A set screw locks the blade engaged end thereof to the blade. Portions of the heating element extend along portions of the length of the passageway within the shaft which terminates in a battery containing compartment. The other end of the shaft is treadingly coupled to a handle portion utilizing a set screw to lockingly secure the handle to the shaft, having a hand grasping undulated rod affixed transverse to the longitudinal axis of the hollow shaft.

A flexible electrical cable enters the battery storing compartment, also having a rectifier and switch apparatus. The lever operating portions of the switch pass through an opening in the compartment walls. The free end of the flexible power cord terminates in a grounded three pole plug, adapted for insertion in a household utility receptacle. The power cord contains three conductors, one of which serves as a grounding conductor and is electrically connected to the metallic portions of the present invention. The remaining two conductors are electrically connected to a transformer, similarly housed within the compartment. The output terminals of the transformer are electrically connected to a full wave bridge rectifier device of the solid state variety, which provides charging current to the battery. The output terminals of the battery and the output terminals of the bridge rectifier circuit connected in parallel therewith, are in turn connected in a series circuit including the terminals of the switch and the terminals of the heating element.

The heating element is adapted to have a heating portion thereof disposed within the hollow shaft adjacent the handle portion of the present invention, so as to provide heat for the user's comfort thereat.

Figure 1:
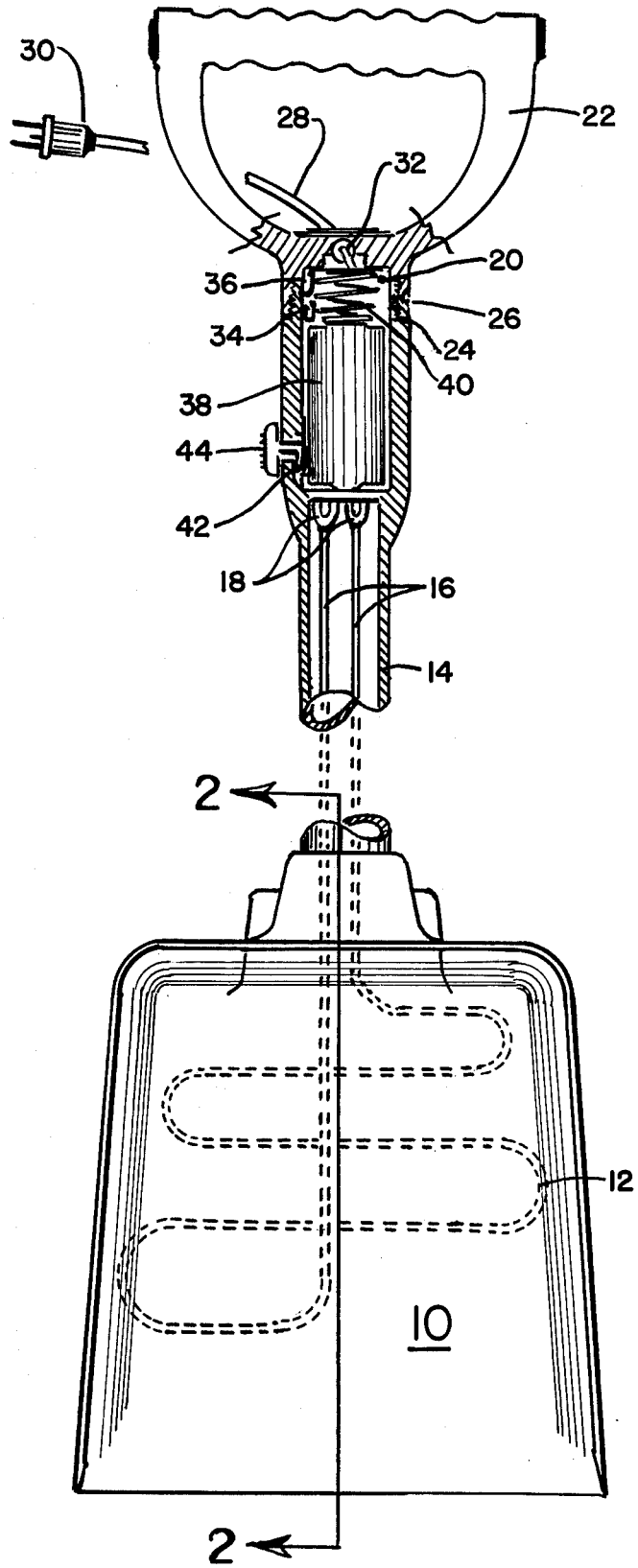
FIG. 1 is a front elevation view of the present invention.

Now referring to the Figures, and more particularly to the embodiment illustrared in FIG. 1 showing a metallic blade shaped housing 10 having a heating element 12, shown in dotted lines, housed therewithin. A hollow tubular shaft 14 is affixed to blade 10 at one end thereof. Portions 16 of heating element 12 extend along the length of shaft 14 and provide heat thereat, when ends 18 are electrically energized. Compartment 20 is included at one end of shaft 14. Handle portion 22 is threadingly affixed to shaft 14 utilizing threads 24 therefor. Set screw 26 prevents the rotation of handle 22 relative to shaft 14. Power cord 28 terminates at its free end in three pronged plug 30 and enters an opening 32 so as to pass into compartment 20 at the other end thereof. Compartment 20 also houses transformer 34, bridge rectifier 36, rechargeable battery 38, spring 40, and switch 42. Spring 40 is utilized to secure battery 38 in a preferred position. Knob 44 operates switch 42 controlling the flow of electrical current to heating element 12. Transformer 34 is connected to the end of flexible power cord 28 disposed within compartment 20. Rectifier 36 converts the alternating current available from the output terminals, not shown, of transformer 34 to a charging current for battery 38, and when switch 42 is closed, into an operating current for heating element 12.

Figure 2:
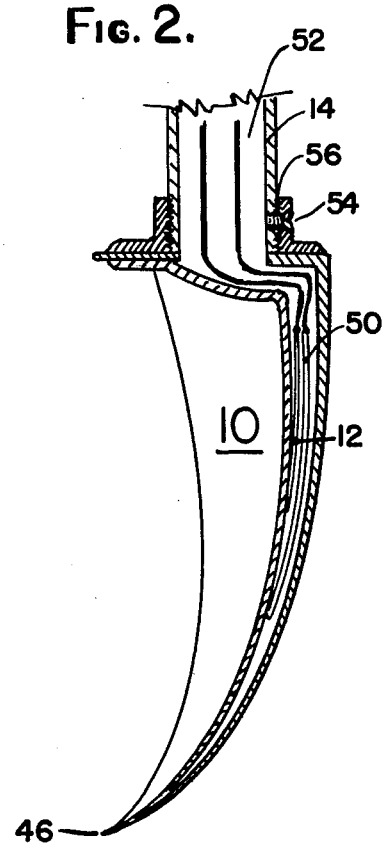
FIG. 2 is a side elevation cross-sectional view taken along lines 2—2 viewed in the direction of arrows 2—2 as shown in FIG. 1.

FIG. 2 illustrates blade 10 having a generally pointed portion 46 at the free end thereof and a side wall portion 48 adjacent an innermost compartment 50. Heating element 12 is shown disposed within compartment 50 and extending along the passageway 52 of hollow tubular shaft element 14. Set screw 54 prevents tubular element 14 from rotating about threads 56, used to interconnect tubular element 14 and blade 10.

One of the advantages of the present invention is a snow removal apparatus, of the household variety, which may be heated utilizing a self contained battery or a power cord consistent with the class of service and the availability of household utility current.

Another advantage of the present invention is a snow removal shovel whose handle portions are warmed so as to comfort the user.

Still another advantage of the present invention is a snow removal apparatus in which the heating element portion, utilized to heat the blade, is totally encased within a metallic unitary shroud thereby minimizing shock hazards due to accidentally damaging the heating element.

Yet another advantage of the present invention is a shovel having conventional structural features, enabling the apparatus to be utilized for digging or other functions other than the removal of snow.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

1. A heated snow shovel comprising a blade, said blade comprising a unitary housing, a heating element, a first portion of said heating element contained within said housing, a shaft, a passageway in said shaft, a second portion of said heating element disposed along said passageway, a handle, one end of said shaft secured to said blade, said passageway communicating with the interior portions of said housing, the other end of said shaft secured to said handle, a compartment, said compartment being disposed adjacent said handle and said other end of said shaft, a rechargeable battery, a power cord, means to recharge said battery when said power cord is energized with an operating current, means to energize said heating element from said battery and from said operating current, means to heat said blade when said heating element is energized, means to heat portions of said shaft and portions of said handle when said heating element is energized, means to manually control the energization of said heating element.

2. The heated snow shovel as claimed in claim 1 wherein said means to recharge said battery comprises a transformer, a rectifier, the input terminals of said transformer being electrically connected to said power cord, the output terminals of said transformer being electrically connected to the input terminals of said rectifier, the output terminals of said rectifier being electrically connected to the terminals of said battery, said battery and said transformer and said rectifier being disposed within said compartment.

3. The heated snow shovel as claimed in claim 2 wherein said means to energize comprises a circuit including the terminals of said heating element being disposed electrically connected to said terminals of said battery and said output terminals of said rectifier.

4. The heated snow shovel as claimed in claim 1 wherein said means to heat said blade comprises said first portion of said heating element being disposed in a circuitous path, said circuitous path being disposed parallel to the lateral surfaces of said blade.

5. The heated snow shovel as claimed in claim 1 wherein said means to heat said portions of said shaft and said portions of said handle includes said second portion of said heating element adapted to heat when said heating element is energized.

6. The heated snow shovel as claimed in claim 3 wherein said means to manually control comprises an operating lever, a switch, said operating lever controlling the electrical state of the contacts of said switch, said operating lever disposed outwardly from said compartment, said switch disposed within said compartment, said switch in series with said terminals of said heating element.

7. The heated snow shovel as claimed in claim 1 wherein said handle is disposed removed from said other end of said shaft, said compartment having an open mouth portion, said open mouth portion providing access to the interior of said compartment.

8. The heated snow shovel as claimed in claim 1 further comprising a three pole household utility plug, said power cord having three conductors, one of said three conductors electrically connected to one of said three poles and said blade, said blade being fabricated from a metallic material.

* * * * *